US005195904A

United States Patent [19]

Cyvoct

[11] Patent Number: 5,195,904

[45] Date of Patent: Mar. 23, 1993

[54] COAXIAL ELECTRICAL CONNECTOR

[75] Inventor: Michel P. Cyvoct, Saint Etienne de Crossey, France

[73] Assignee: Radiall, Rosny sous Bois, France

[21] Appl. No.: 804,944

[22] Filed: Dec. 11, 1991

[30] Foreign Application Priority Data

Dec. 18, 1990 [FR] France ..... 90 15835

[51] Int. Cl.[5] ..... H01R 13/627

[52] U.S. Cl. ..... 439/349

[58] Field of Search ..... 439/349, 345, 610, 96, 439/108, 609, 95, 98, 99, 94, 607, 903

[56] References Cited

U.S. PATENT DOCUMENTS

| | | | |
|---|---|---|---|
| 3,193,309 | 7/1965 | Morris | 439/349 X |
| 3,793,610 | 2/1974 | Brishka | 339/74 R |
| 4,022,966 | 5/1977 | Gajajiva | 439/98 X |
| 4,655,532 | 4/1987 | Hillis et al. | 439/108 X |

FOREIGN PATENT DOCUMENTS

| | | |
|---|---|---|
| 0050575 | 4/1982 | European Pat. Off. . |
| 2045384 | 9/1970 | Fed. Rep. of Germany . |
| 2204331 | 6/1974 | France . |

*Primary Examiner*—Gary F. Paumen

*Attorney, Agent, or Firm*—Schweitzer Cornman & Gross

[57] ABSTRACT

The invention relates to a quick locking and unlocking coaxial electrical connector having two connector elements and a peripheral release sleeve. One of the connector elements (2) has an elastic external contact socket (9) which has a diameter corresponding substantially to the diameter of the annular wall (24) of the peripheral release sleeve (23), the elastic socket having a front end disposed within an annular recess (12) of the body (10, 11) of the connector element, the connector having an elastic keeper provided with inclined portions (21, 22) projecting radially outwardly and disposed between the confronting ends of the elastic socket and of the annular wall of the peripheral sleeve.

1 Claim, 3 Drawing Sheets

COAXIAL ELECTRICAL CONNECTOR

BACKGROUND OF THE INVENTION

The present invention relates to a coaxial electrical connector of the type having a male element and a female element which can be connected removably to one another, having on the connector elements cooperating locking means resistant to axial traction, and release means which can produce a release of the said locking means to permit separation of the elements of the connector.

In FR-A-2,492,598, corresponding to EPO 0050575 and assigned to the assignee of the present invention, an electrical connector of this type is described providing good electrical connecting properties and mechanical strength, particularly during relative axial displacement of the elements, while requiring little effort for the coupling and uncoupling of the connector elements.

In this document, each of the connector elements has a central contact of the pin and socket type, respectively, which can cooperate with the central contact of the other element when the connection is made, one of the elements comprising an external ground contact in the form of a socket with radial elasticity and a body in which a recess is made in which an annular elastic keeper is inserted and held, of an open contour, comprising radial projections which can be engaged in the annular groove of the first connector element when the two connector elements are brought axially together, and a peripheral release sleeve which can slide along the second connector element and has an annular wall designed to engage the elastic keeper and push the latter into the recess so as to release the keeper from the throat of the first connector element.

In the known connector the elastic keeper is composed of a strip cut from elastic material having a plurality of spaced projections presenting a curved surface, the annular recess designed to receive and retain the keeper having two inclined walls, one made by machining the body of the corresponding connector element, the other being part of a ring crimped onto the end of the body. Supplemental means, such as an annular clip, are furthermore provided in order to assure that the keeper will be retained in the recess in the body.

On account of the small dimensions of such connectors, the manufacture of such keepers and such recesses in the body of one element of the connector is complex and relatively expensive.

Furthermore, the recess intended to house and retain the elastic keeper is made in the body of the second connector element at a relatively great radial distance from the resilient ground contact socket of this second connector element to permit the socket of the first connector element to lodge in an annular space provided between the elastic socket, the said recess containing the elastic keeper. This considerably increases the bulk in the radial direction of the connector and therefore its outside diameter.

SUMMARY OF THE PRESENT INVENTION

The present invention proposes to provide a connector permitting simplified and therefore less troublesome manufacture of the elastic keeper and of the connector element intended to receive it, while considerably reducing the bulk in the radial direction of this connector element.

The connector according to the present invention is characterized essentially by the fact that the elastic socket of the outside ground contact of the second connector element has a diameter corresponding substantially to the diameter of the annular wall of the peripheral release sleeve, the elastic socket having a front end disposed within the said annular recess of the body of the second connector element, and that the elastic keeper has inclined portions projecting radially toward the outside and disposed between the confronting ends of the elastic socket and of the annular wall of the peripheral sleeve.

The elastic keeper advantageously is in the shape of a V with a truncated apex in section, that is, with a cylindrical center core and on either side of the latter two inclined side branches projecting radially outward, forming between them an angle preferably on the order of 90 degrees, and disposed one facing the end of the elastic socket of the second connector element and the other the end of the annular wall of the peripheral release sleeve.

Preferably, the end faces of the elastic socket of the second connector element and of the annular wall of the peripheral release sleeve are chamfered to contribute to the radially outward guidance of the elastic keeper in the recess of the body of the second connector element at the time of disconnection.

It can thus be understood that, contrary to what is the case in the previous document, the annular cavity of the body of the second connector element no longer needs to have two inclined walls, a single inclined wall being sufficient to provide guidance for the end of one of the inclined sides of the annular keeper at the time of release and, furthermore, no additional holding means is needed to hold the keeper in the corresponding recess when the connector is detached.

For the purpose of clarifying the invention a description will now be given, as nonlimiting examples, of two embodiments, referring to the annexed drawing.

DETAILED DESCRIPTION OF THE INVENTION

Figure 1:
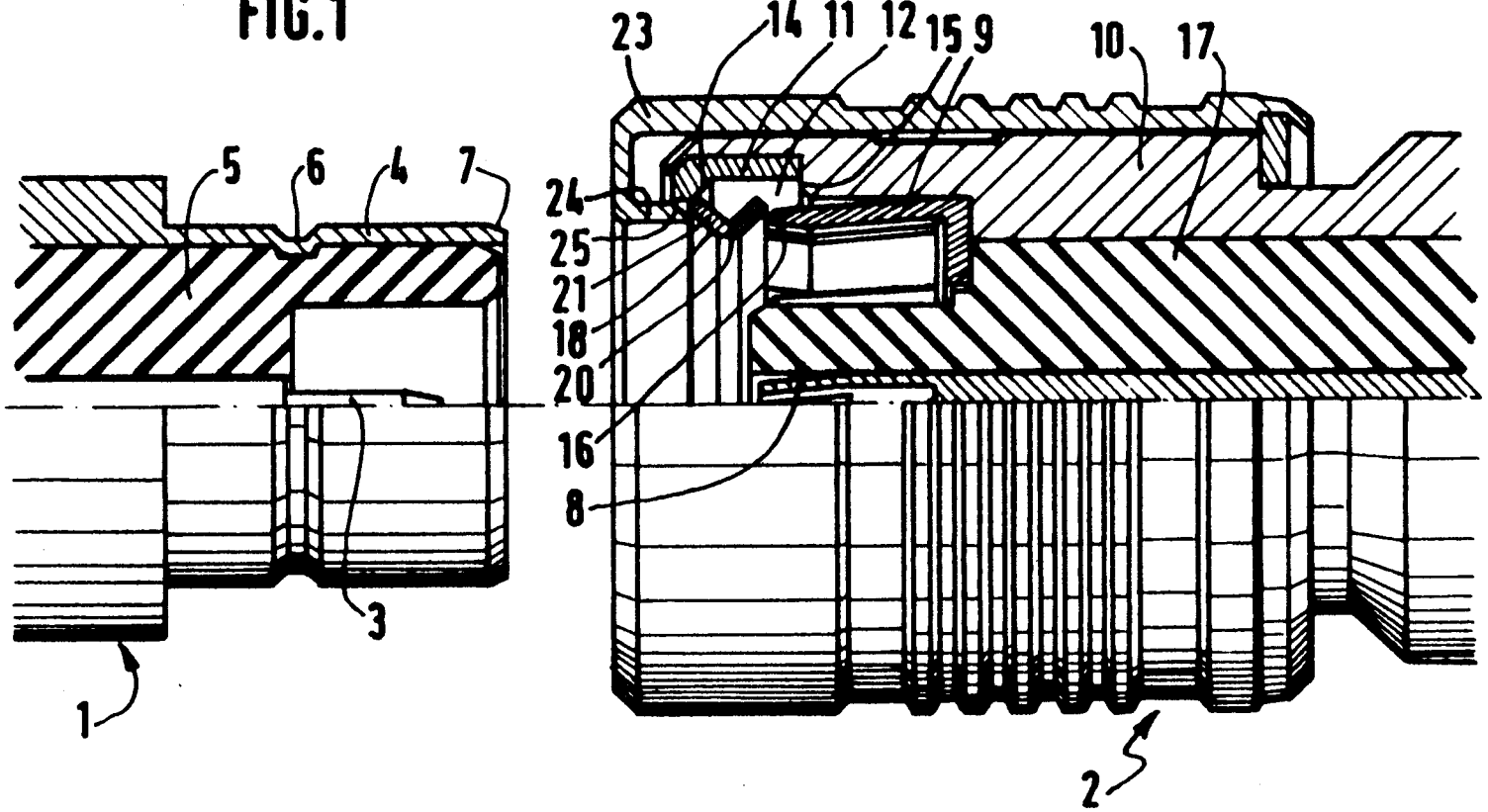
FIG. 1 is an elevation, partially in section, representing the end portions of the elements of a coaxial connector according to one embodiment of invention in the detached position.

First we shall refer to FIGS. 1 to 4.

A coaxial connector according to the invention is composed of a first connector element identified generally by 1, and of a second connector element identified generally by 2.

The first element of connector 1 is a male element and has a center contact in the form of a pin 3, an external ground contact in the form of an annual sleeve 4, and an insulating sleeve 5. In the peripheral wall of the external contact sleeve 4 there is an annular groove 6. More precisely, the groove 6 has a profile matching the profile of the annular keeper 18, which will be described in greater detail below, so as to assure that it will be well held in the coupling position. The groove 6 thus has, in the example depicted, a truncated-V-shaped profile with a cylindrical bottom wall and two spaced truncoconical side walls extending radially and axially from the bottom wall.

The front end (to the right in the FIGS.) of the socket 4 has an end chamfer 7.

The complementary connector element 2, arranged as a female element, has a center contact in the form of a socket 8 whose end portion has a radial elasticity brought about in a known manner, for example by axially extending longitudinal slots, and an external ground contact comprising a socket 9 of radial elasticity and a body composed of two parts 10 and 11, respectively. Parts 10 and 11 of the body are fixed together and made, as shown in the drawing, so as to define an annular recess 12 terminating at the front (to the left in the drawing) in an inclined wall 14 formed on part 11 of the body and at the rear in a straight wall 15 made in part 10 of the body.

The socket 9 has a radial elasticity due to the presence, in a known manner, of longitudinal slots extending from its extremity 16, this extremity 16 being furthermore chamfered and being disposed at the interior of the annular recess 12.

The connector element 2 furthermore comprises an insulator 17 between the center contact 8 formed by socket 9 and the outer contact, and an annular elastic keeper 18 of a section substantially in the shape of a V with a truncated apex.

Figure 4:
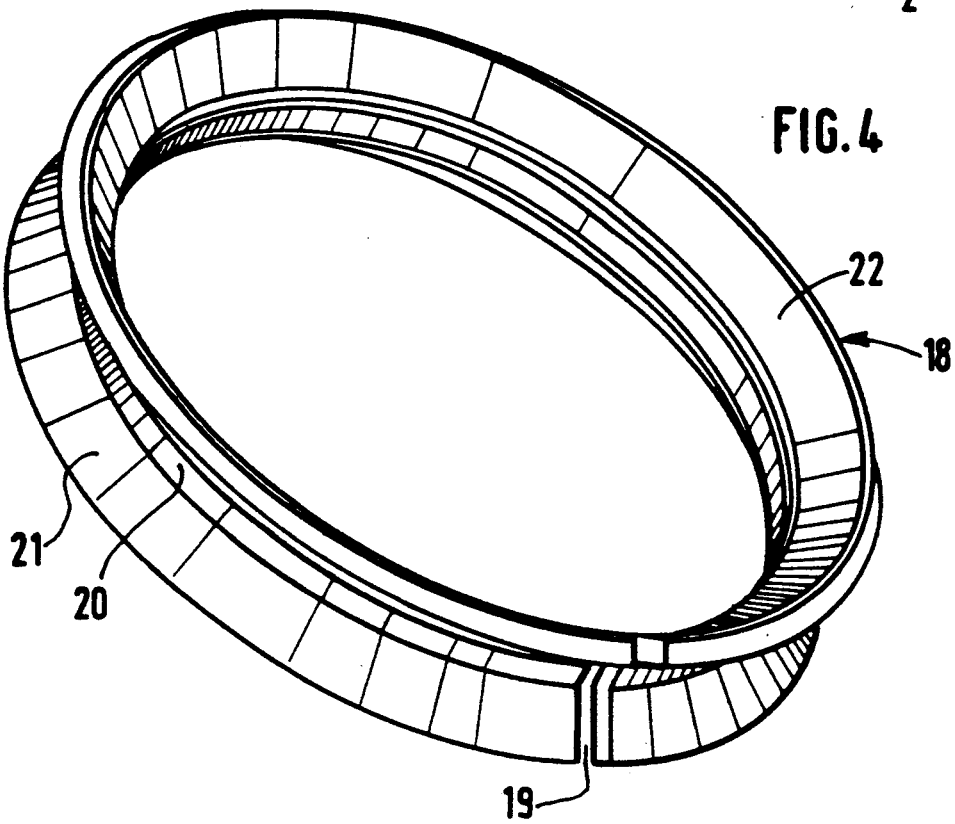
FIG. 4 shows an embodiment of the keeper that can be used in the connector according to the invention.

The structure of the keeper 18 which is a separate component is best seen in FIG. 4. The keeper is split at 19 and comprises a cylindrical center core 20 from which two branches 21 and 22 extend radially and axially outward.

The keeper 18 is made of resilient material, such as beryllium copper.

The connector element 2 comprises a release member consisting of a peripheral sleeve 23 which can axially slide along the peripheral wall of part 10 of the body (direction A, FIG. 3), this sleeve comprising a radially inward and axially extending annular wall 24 provided with an end chamfer 25 and hooking inside of the body.

The diameter of the annular wall 24 of the sleeve 23 corresponds substantially to the diameter of the elastic socket 9, so that the chamfered ends 16 of the socket, and 25 of the annular wall, are substantially facing one another on either side of the branches 21 and 22 of the elastic keeper 18.

To accomplish the locking of the connector starting from the unassembled position of FIG. 1, it suffices to axially push the connector element 1 into the interior of the connector element 2 until the elastic keeper 18 snaps into the groove 6. This can be done by applying an axial thrust to the sleeve 23 or to part 10 of the body.

Figure 2:
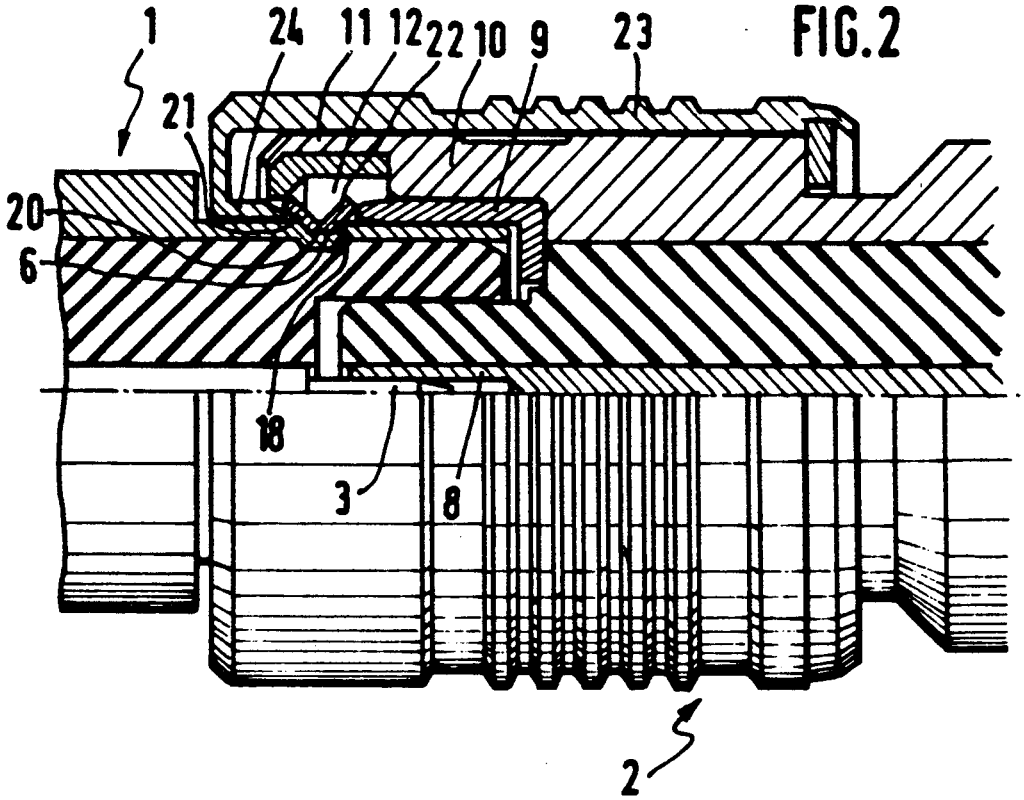
FIG. 2 represents the end portions of the elements of the coaxial connector of FIG. 1 in the coupled position.

The assembled state is depicted in FIG. 2.

It can be seen in this Figure that the annular keeper 18 held in groove 6 is positioned axially between the ends of the socket 9 and the annular wall 24 of the release sleeve 23. The outer contact sleeve 4 of connector 1 engages socket 9 in this position.

If an axial displacement is applied to the body portion 10, when the connector is in the assembled state, the annular keeper 18 remains held in the groove 6 by being clamped between the right (in the drawing) side wall of the groove 6 and the inclined wall 14 of portion 11 of the body.

Figure 3:
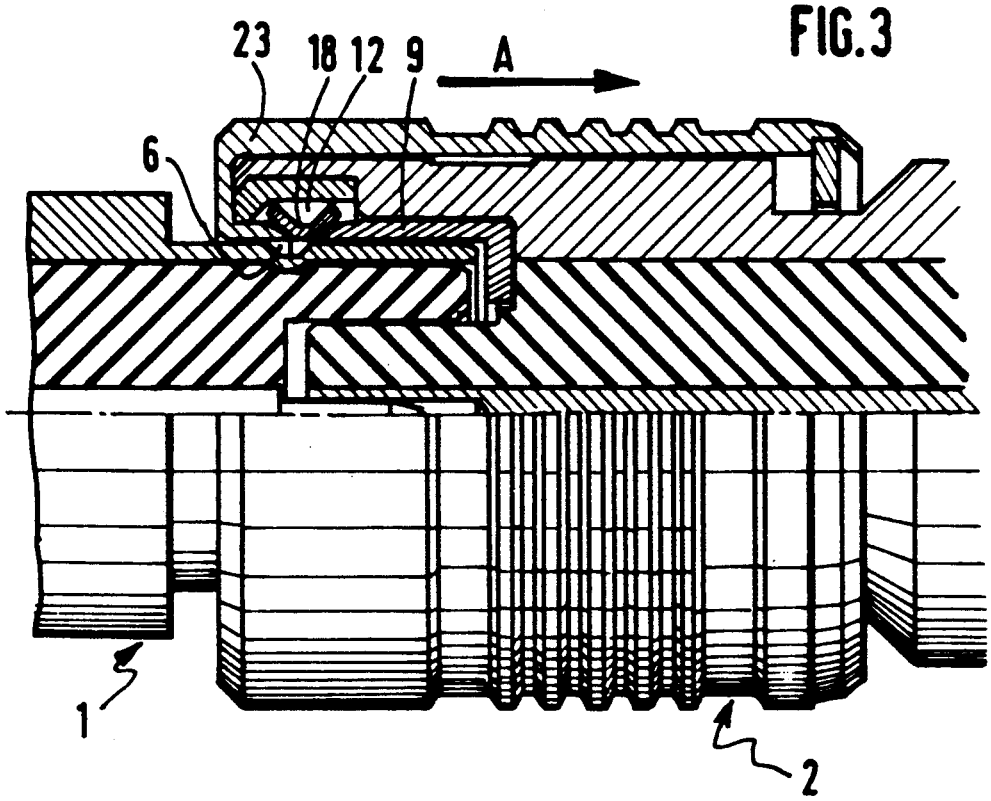
FIG. 3 represents the end portions of the coaxial connector of FIG. 1 as they are being uncoupled.

To produce the release starting from the assembled position in FIG. 2, the release sleeve 63 is pushed back in the direction of arrow A in FIG. 3. The chamfer 25 of the annular wall 24 cooperates with the inclined branch 21 of the keeper 18 and separates the keeper 18 from the groove 6. By continuing to pull push on the release sleeve the two elements of the connector are disconnected.

When the sleeve 23 is released it returns to its forward position depicted in FIGS. 1 and 2 under the action of the elastic keeper 18, which closes again and resumes its free position shown in FIG. 4.

Figure 5:
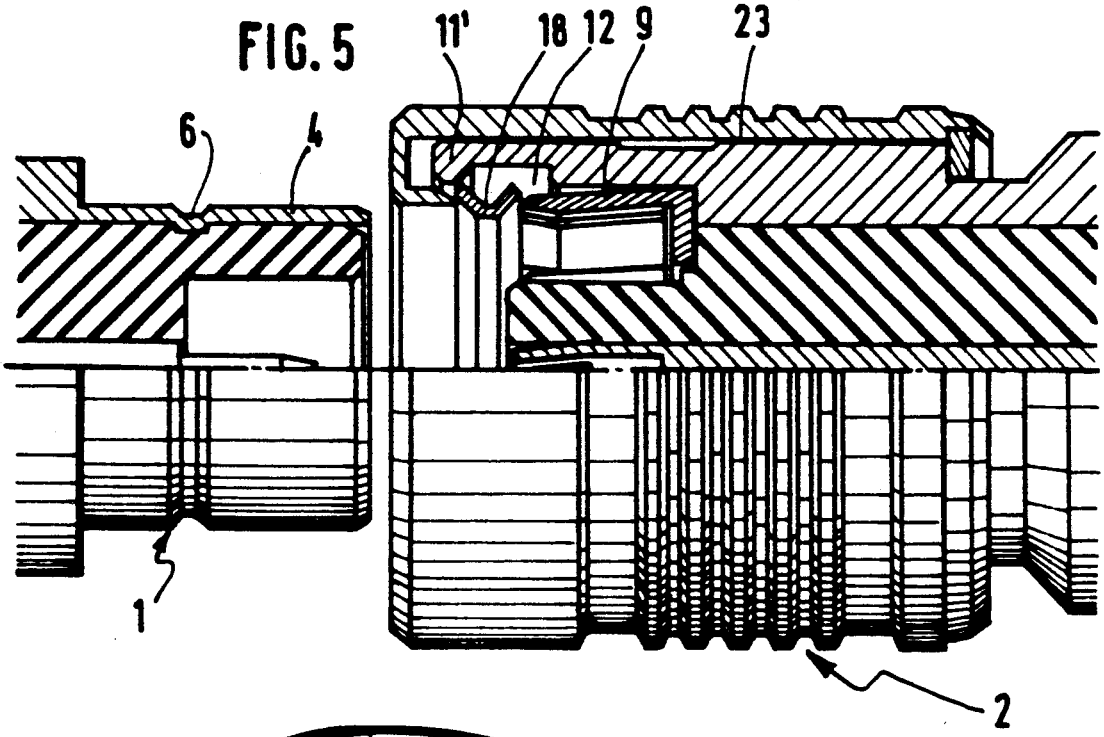
FIG. 5 is a view similar to FIG. 1 of a variant coaxial connector according to a second embodiment of the invention.

The connector depicted in FIG. 5 differs from that of FIGS. 1 to 3 only in that the body 11' of the exterior ground contact of the second connector element 2 is made in one piece, not in two assembled parts 10 and 11.

This embodiment permits a still further reduction of the radial bulk of the second connector element and therefore of its outside diameter.

Although the invention has been described in connection with preferred embodiments, it is obvious that it is by no means limited thereto, and that variants and modifications can be made to it without departing from its scope or its spirit.

I claim:

1. Quick locking and releasing coaxial electrical connector comprising two connector elements, one of said elements having a center contact of a pin type and the other of said elements having a center contact of a socket type; said two connector elements being adapted to axially engage at the time of connection; said one element including an external ground contact sleeve; an outer wall of said ground contact sleeve having an annular groove; the other connector element of said two elements including an external ground contact forming a socket of radial elasticity; the ground contact sleeve and elastic external ground contact socket engaging at the time of said axial engagement; said other element comprising a body having a recess in which there is lodged and retained an annular elastic keeper having radial projections; said keeper being adapted to engage the annular groove of said ground contact sleeve when the two connector elements are axially engaged; and a peripheral release sleeve slideably secured to the other connector element body and having an annular wall for engaging said elastic keeper and for pushing said elastic keeper into the recess so as to disengage the keeper from the groove of said ground contact sleeve characterized by said elastic external ground contact socket of the other connector element having a diameter corresponding substantially to the diameter of the annular wall of the peripheral release sleeve; said elastic external ground center contact socket having an end inside of the annular recess of the body; said annular wall having an end, the ends of said elastic center contact socket and said annular wall facing each other; the elastic keeper including inclined portions projecting radially outwardly relative to the center contact and disposed between the facing ends of the elastic external ground center contact socket and of the annular wall of the peripheral sleeve, said elastic keeper having a V shaped cross section with a truncated apex; a cylindrical central core and, on each side of the apex, an inclined lateral branch projecting radially outwardly toward the exterior; said lateral branches of the keeper forming between them an angle of about 90 degrees.

* * * * *